US006313810B1

(12) United States Patent
Andersson et al.

(10) Patent No.: US 6,313,810 B1
(45) Date of Patent: Nov. 6, 2001

(54) ARRANGEMENT RELATING TO ANTENNA PROTECTION

(75) Inventors: Carl-Gunnar Andersson, Sandlidsvägen; Bo Josefsson, Olbersgatan; Ingemar Bengtsson, Vallby, all of (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 09/662,172

(22) Filed: Sep. 14, 2000

(51) Int. Cl.[7] ..... H01Q 1/42; H01Q 1/28
(52) U.S. Cl. ..... 343/872; 343/705; 343/708
(58) Field of Search ..... 343/872, 705, 343/708, 841, 701, 706, 707; H01Q 1/42, 1/28

(56) References Cited

U.S. PATENT DOCUMENTS

| | | | |
|---|---|---|---|
| 5,159,521 | 10/1992 | Guangrun et al. | 361/117 |
| 5,353,038 | 10/1994 | Osborne et al. | 343/708 |
| 5,405,107 * | 4/1995 | Bruno | 343/708 |
| 5,542,624 | 8/1996 | Smith | 361/218 |
| 5,575,438 * | 11/1996 | McGonigle et al. | 343/705 |
| 5,862,032 | 1/1999 | Cann | 361/217 |
| 6,094,171 * | 7/2000 | Riddle et al. | 343/708 |

FOREIGN PATENT DOCUMENTS

98/58398 12/1998 (WO) .

* cited by examiner

*Primary Examiner*—Hoangahn Le
(74) *Attorney, Agent, or Firm*—Burns, Doane, Swecker & Mathis, LLP

(57) ABSTRACT

The present invention relates to an atmospheric discharge protection arrangement in an antenna (10) arranged in communication with a hull of an aircraft (11), the antenna comprising a housing, consisting of at least a first side (14), a second side (15), a third side (16*a*) and a fourth side (16*b*), at least one of the third and fourth sides being at least transparent for electromagnetic waves. The protection arrangement is an internal protection arrangement comprising the first side (14) electrically coupled to the second side (15) through at least one antenna element (24), the first and second sides consisting of a conductive material, and that the second side being connected to hull of the aircraft (11).

10 Claims, 3 Drawing Sheets

ARRANGEMENT RELATING TO ANTENNA PROTECTION

TECHNICAL FIELD OF THE INVENTION

The present invention relates to an atmospheric discharge protection arrangement in an antenna, specially an airborne radar antenna, e.g. arranged on an aircraft.

BACKGROUND OF THE INVENTION

The main requirement for a lightning protection of an airborne radar or other antennas is to provide full protection so that the flight safety of the aircraft is not jeopardized by mechanical damage or loosened parts, which can damage the engine and/or steering parts of the aircraft. At the same time, the protection of the expensive electronics inside or connected to the antenna must be guaranteed.

Moreover, for proper function of the radar, it must be provided with "windows" which are transparent for the radiation (microwave radiation), meaning that the entire housing of the radar cannot be made of conductive material or plastic material reinforced with conductive metal, for preventing damages caused by the strike of the lightning.

DESCRIPTION OF THE RELATED ART

Several types of lightning protections for aircrafts rafts and airborne antennas are known.

WO 98/58398, for example, describes a lightning protection element that may be incorporated into the antenna receiver and signal distribution system of an aircraft. The lightning protection element rejects harmful energy associated with lightning strikes while passing electronic signals without significant interference with those signals. The lightning protecti on element comprises an optical fibre element. The optical fibre rejects damaging energy associated with lighting strikes while passing communications signals transmitted on said signal distribution system.

Through U.S. Pat. No. 5,542,624 a lightning strike protection for an aircraft or part of an aircraft is known, which is provided by mounting metal (aluminium) rods adjacent but spaced from the inner surface of the aircraft wall. The rods are provided with ball joints from which extensions through the wall stand proud of the aircraft outer surface and within the material of static dischargers. The rods are coupled to bus bar which run the length of the aircraft and in turn are coupled to lightning strike dischargers, again in the form of metal rods carried on but spaced from the wall of an aircraft and having extensions which pass through the aircraft wall. The application of the lightning strike protection system to radomes, antennas, pitot tubes carbon fibre reinforced plastics structures is discussed, in the former two cases metal rods being provided to extend in the null field of a device within the radome or the antenna. The mounting of the conductive rods spaced from the wall of the aircraft means that they may safely take surges of electromotive force caused by lightning strikes without damaging the fabric of the aircraft wall.

U.S. Pat. No. 5,353,038 discloses a surface conforming sense antenna integrated with the surface skin of an aircraft by removing a rectangular looped strip of a metallized exterior composite surface skin. The remaining interior metallized portion isolated from the exterior metallized section forms an antenna sense element. The inner metallized portion is connected to an ADF radio receiver to function as a sense antenna in conjunction with a loop antenna. The gap between the metallized inner portion of the exterior metallized section allows lightning energy to be discharged thereacross. The modification does not impose a weight penalty or a wind drag penalty and does not degrade lightning protection for the composite aircraft.

SUMMARY OF THE INVENTION

One of the objects of the present invention is to provide a simple and yet an efficient lightning protection arrangement which protects an antenna, specially an airborne radar antenna both internally and externally.

Another object of the invention is to provide a protection arrangement, which besides mechanical protection of the antenna also provides an efficient protection of the electronics and electrical parts connected to the antenna.

For these reasons the initially mentioned antenna comprises a housing, consisting of at least a first side, a second side, a third side and a fourth side, at least one of said third and fourth sides being at least transparent for electromagnetic waves. The protection arrangement is an internal protection arrangement comprising said first side electrically coupled to said second side through at least one antenna element. The first and second sides consist of a conductive material. The second side is further connected to the hull of said aircraft.

The arrangement further comprises an external protection in form of conductive wires arranged at least on said third or fourth side. In one embodiment, said second side is a part of said hull.

To prevent flashovers said antenna element is at least one antenna plate. Moreover, the first and second sides are electrically coupled together with a low-resistance through said antenna element along the entire length of the antenna.

Preferably, said first and second sides are covered or made by a conductive material.

Moreover, as part of the external protection the conductive wire is arranged to conduct the atmospheric discharge towards at least one of said first and second sides.

Moreover, the antenna can comprise a fifth and a sixth conductive side.

According to a method of the invention, to internally protect an antenna arrangement against atmospheric discharges, the antenna being provided in communication with a hull of an aircraft, said antenna comprising a housing, consisting of at least a first side, a second side, a third side and a fourth side. At least one of said third and fourth sides are at least transparent for electromagnetic waves, said first and second sides consisting of a conductive material. The method comprises the steps of electrically coupling said first side to said second side through at least one antenna element, and connecting said second side to the hull of said aircraft. The method comprises the further step of arranging said third and fourth sides with conductive wires, which wires conduct a discharge current towards said first or second side.

BRIEF DESCRIPTION OF THE DRAWINGS

In the following, the invention will be described further, in a non-limiting way, with reference to the accompanying drawings, in which.

DETAILED DESCRIPTION OF AN EMBODIMENT

In the following, an example showing a radar system, ERIEYE, a product from the applicant, is shown in conjunction with description of the aspects of the invention. ERIEYE is a high-performance, long-range Airborne Early Warning & Control (AEW&C) system based on an AESA Doppler radar. However, other types of mobile or stationary antennas, radar antennas or electrical equipments made of a conductive material exposed to atmospheric discharges are included within the scope of the invention.

Figure 1:
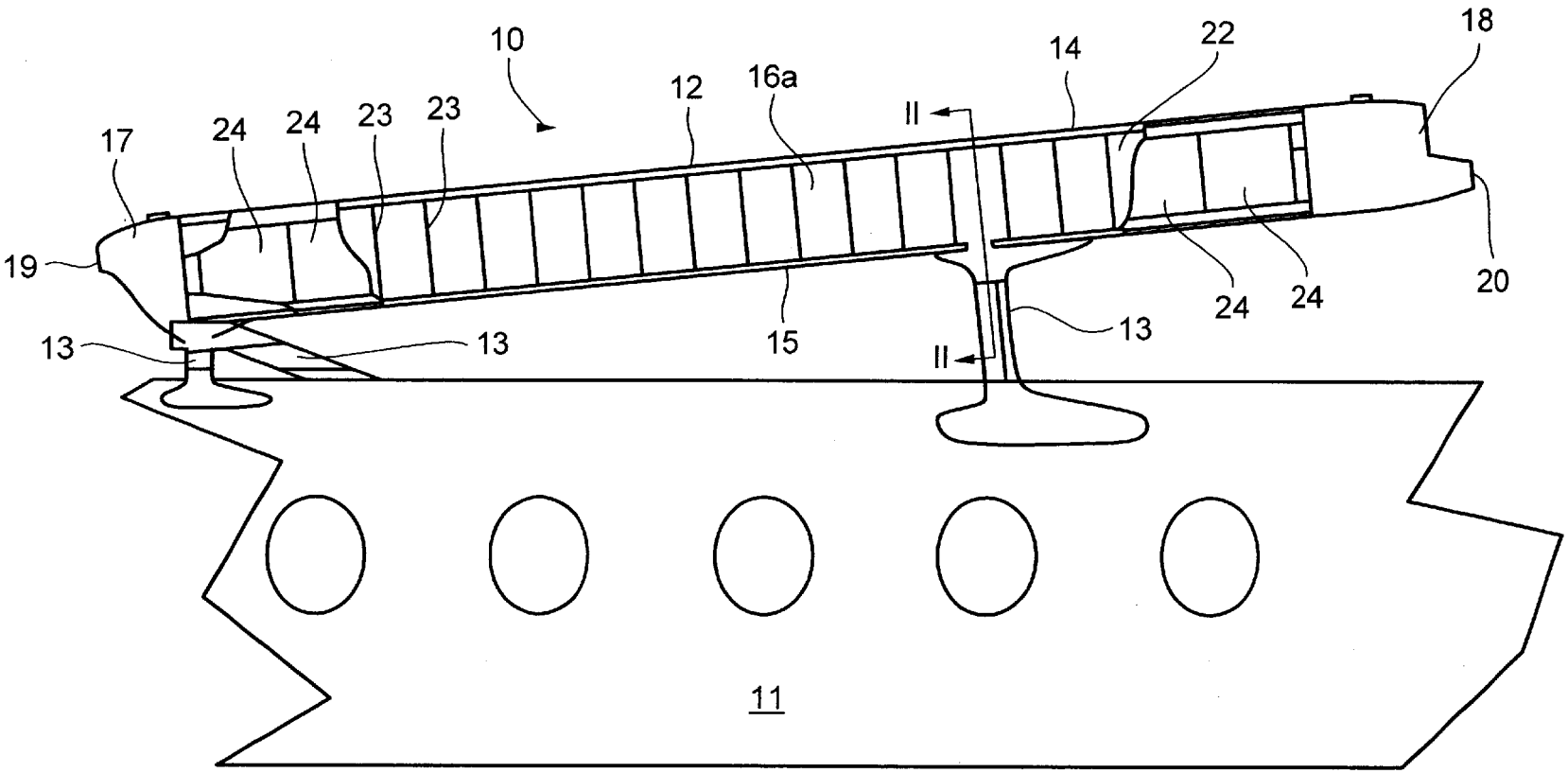
FIG. 1 is a schematic illustration of an airborne radar antenna provided with a lightning protection according to the present invention with some exterior parts removed.
Figure 2:
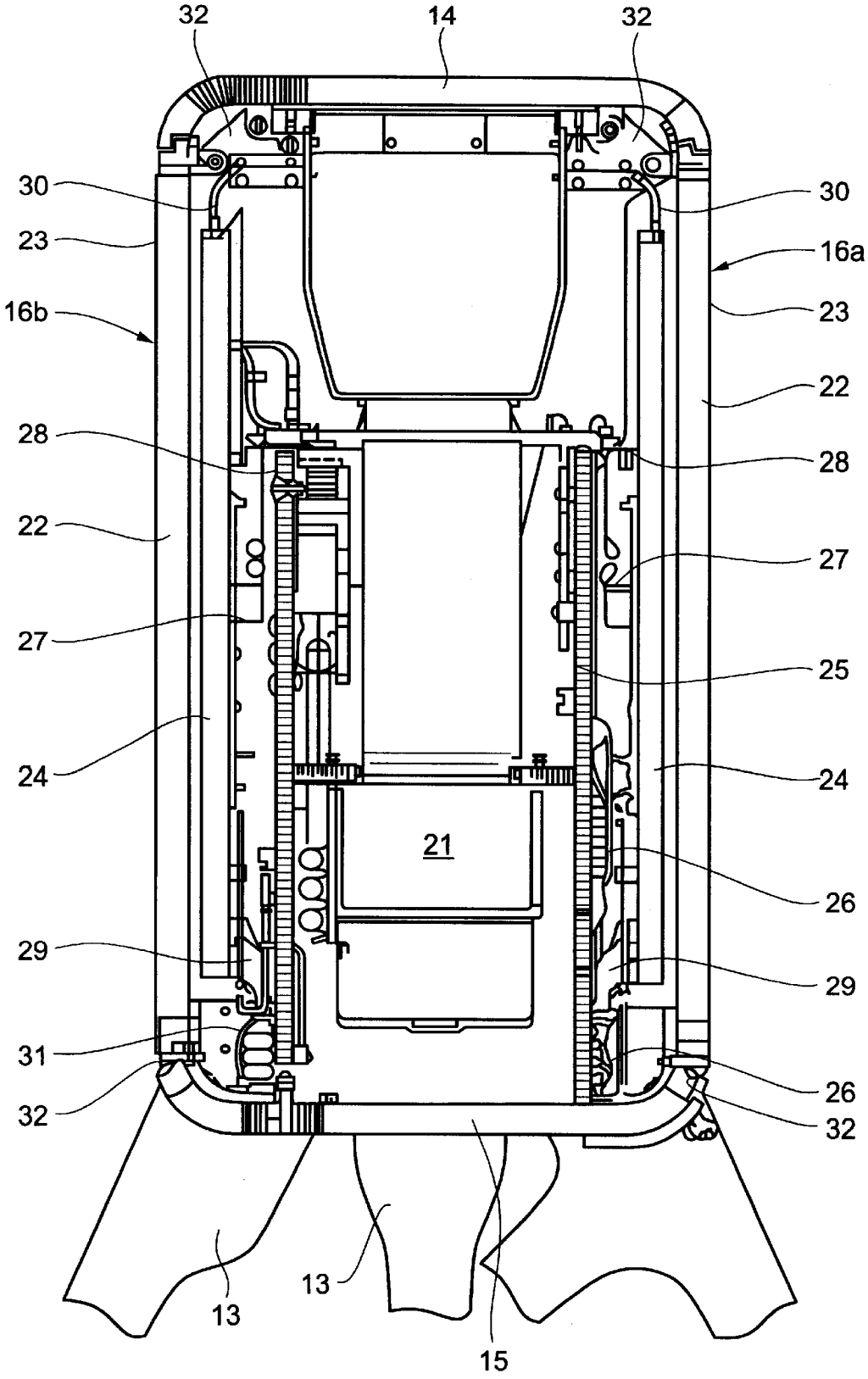
FIG. 2 illustrates a cross-section along line II—II in FIG. 1.

FIGS. 1 and 2 show a radar (ERIEYE) arranged on the hull of an aircraft 11 (partly shown). The radar antenna 10 comprises a housing 12 supported by front and rear struts 13. The housing comprises an upper portion or cover 14, lower portion or bottom 15, side walls or right and left radomes 16*a* and 16*b*, respectively, nose 17 and tail 18. A first opening 19 is arranged in the nose, which is connected to a second opening 20 via an internal air channel 21. The radomes 16*a*, 16*b* are covered with transversely and sparsely arranged conductive wires 23. The conductive wires 23, preferably copper threads, are arranged on the outside of the radomes and can be in contact (but not necessary) with the cover 14 or the bottom 15. Shear plates 22 or fillers are arranged between the internal parts of the antenna to provide the antenna with better shearing resistance and stability.

In FIG. 1 some parts of the radomes are removed exposing a number of longitudinally arranged left and right antenna elements or antenna plates 24. According to the cross-section of FIG. 2, an internal supporting H-structure 25 is arranged inside the antenna, which among other things carries electrical conductors 26, supports antenna plates 24 and other parts not relevant for the invention. The H-structure is, for example, made of carbon fibre.

Antenna plates 24 are fed through feeding connections 27 connected to microwave sources/receivers (not shown). Each antenna plate is suspended to and supported by the H-frame 25 at its upper and lower part by means of mountings 28 and 29, respectively. The cover, bottom and the sides are connected by means of holders 32.

The wires 30 galvanically connect the cover 14 to the antenna plates 24 at each side. The cover is covered with or made by a conductive material, preferably expanded metal. The antenna plates 24 are also galvanically connected to the bottom 15 of the housing through wires 31, illustrated by dashed lines. Also, the bottom is covered with or made of a conductive material, preferably expanded metal. Thus, the cover 14 is low-resistantly connected to the bottom through the antenna plates 24. The bottom is galvanically connected to the struts 13. Also, the nose 17 and the tail 18 may also be covered with or made of a conductive material, e.g. expanded metal.

Figure 3:
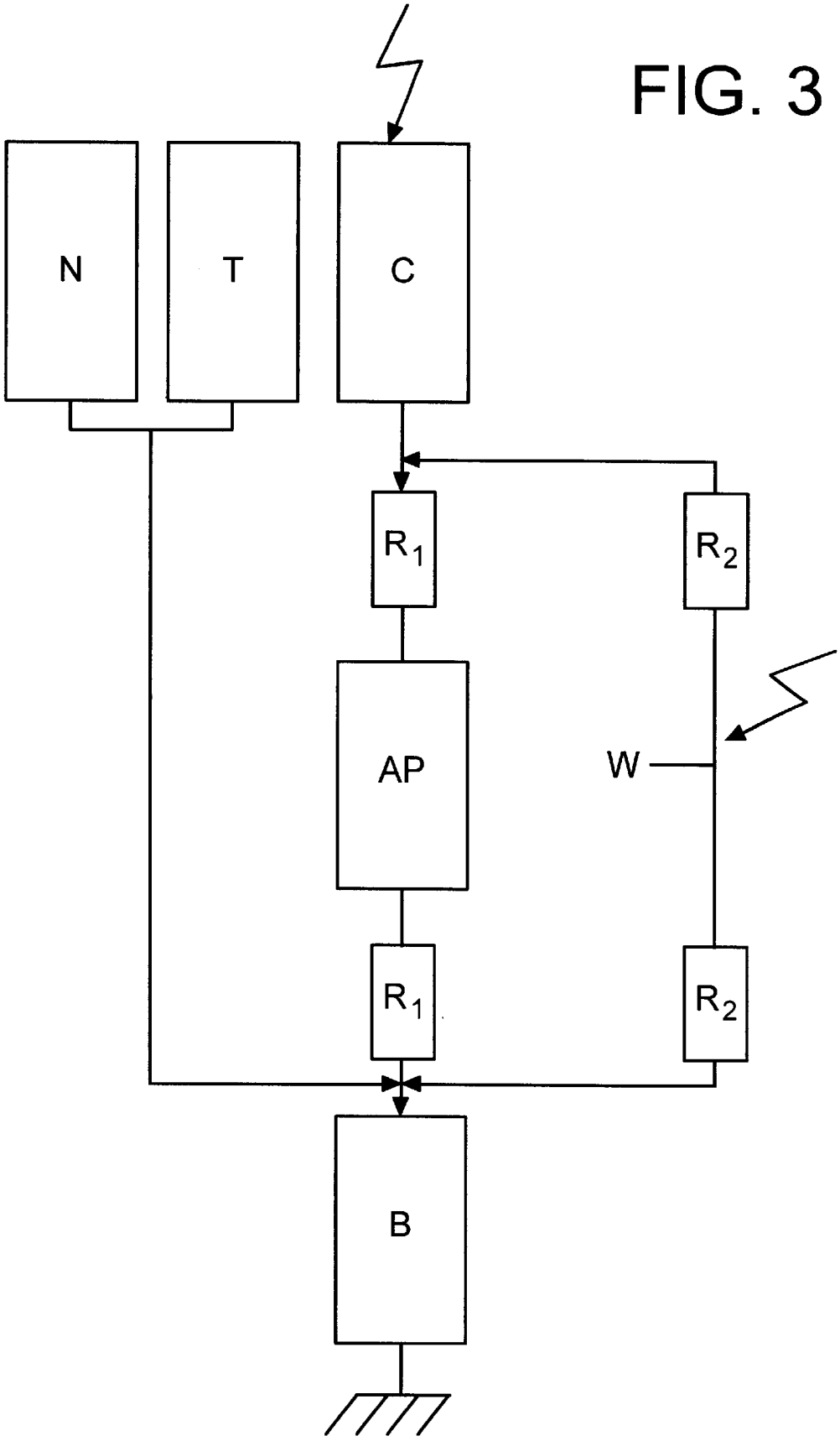
FIG. 3 is a block diagram illustrating the principle of the invention.

To simplify the understanding of the invention, the antenna is illustrated by means of the block diagram of FIG. 3. In the block diagram, the cover 14 is represented by C, antenna plate 24 by AP, bottom 15 by B, the conductive wire 23 by W, nose 17 by N and tail 18 by $T.R._1$ relates to the resistance between the cover and the antenna plate and also between the antenna plate and the bottom; $R_2$ relates to the resistance between the cover and the conductive wire and also between the bottom and the conductive wire, respectively, wherein $R_2 >> R_1$.

Accordingly, the lightning protection according to the invention is provided in two parts: an external protection and an internal protection.

The external protection comprises the radomes which are provided with the sparsely arranged conductive wires W, the function of which is to conduct the lightning current towards the cover and/or bottom. The wires are substantially thin so that they do not effect the performance of the radar.

The second protection comprises the cover C and the bottom B, and preferably also the nose N and the tail T, which are covered with or made of a conductive material. Both the nose and the tail may be connected to the cover and/or bottom. The bottom is grounded, i.e. connected to the hull of the aircraft through bonding (not shown) or struts 13. To avoid high voltages, which can cause flashover, breakdown and damages hazardous for the flight security, the cover and the bottom are electrically coupled together with low-resistant $R_1$ along the entire length of the radar antenna. This low-resistive coupling cannot be obtained through the radomes as the conductive wires W do not contact the cover and the bottom (very large $R_2$). Therefore, the low-resistive coupling is obtained through connection via the antenna plates, which constitute part of the lightning conductor.

When a lightning strikes the antenna, probably at one of the cover C, nose N, tail T and/or side radomes, the conductive wires W conduct the generated current towards the cover C and/or bottom B. The current conducted towards the bottom B is further conducted towards the aircraft hull (ground). The current conducted towards cover C is conducted through cables 30, antenna plate AP, cables 31 and the bottom B towards the aircraft hull (ground). Hence, if there were no low resistance connections between the cover and the bottom, the current conducted from the cover to the bottom could cause flashovers.

It is of course possible to provide other conducting elements (e.g. behind the antenna plates) to conduct the lightning strike current. However, this type of connection must guarantee a low impedance connection so that no flash over between the element and the antenna plates, or other parts, is generated.

Clearly, it is possible to eliminate the cover or bottom, by using the hull of the aircraft as one of these parts. Moreover, terms "cover" and "bottom" refer to constructional sides and can be side sections in, e.g. a cube-shaped antenna arrangement.

The invention is not limited the shown embodiments but can be varied in a number of ways without departing from the scope of the appended claims and the arrangement and the method can be implemented in various ways depending on application, functional units, needs and requirements etc.

We claim is:

1. An atmospheric discharge protection arrangement in an antenna arranged in communication with a hull of an aircraft, said antenna comprises a housing, comprising at least a first side, a second side, a third side and a fourth side, at least one of said third and fourth sides being at least transparent for electromagnetic waves, wherein said protection arrangement comprises an internal protection arrangement comprising said first side electrically coupled to said second side through at least one antenna element and that said second side is connected to hull of said aircraft.

2. The arrangement of claim 1, further comprising an external protection in form of conductive wires arranged at least on said third or fourth side.

3. The arrangement of claim 2, wherein said conductive wire is arranged to conduct the atmospheric discharge towards at least one of said first and second sides.

4. The arrangement of claim 1, wherein said antenna element is an antenna plate.

5. The arrangement of claim 1, wherein said first side and said second side are electrically coupled together with a low-resistance through said antenna element along the entire length of the antenna.

6. The arrangement of claim 1, wherein said first and second sides are at least partly covered or made by a conductive material.

7. The arrangement of claim 1, wherein said antenna comprises a fifth and a sixth conductive side.

8. The arrangement of claim 1, wherein said second side is a part of said hull.

9. A method of internally protecting an antenna arrangement against atmospheric discharges the antenna being provided in communication with a hull of an aircraft, said antenna comprising a housing, consisting of at least a first side, a second side, a third side and a fourth side, at least one of said third and fourth sides being at least transparent for electromagnetic waves, said first and second sides consisting of a conductive material, said method comprising the steps of electrically coupling said first side to said second side through at least one antenna element, and connecting said second side to the hull of said aircraft.

10. A method according to claim 9, the method comprising the further step of arranging said third and fourth sides with conductive wires, which wires conduct a discharge current towards said first or second side.

* * * * *